US007256538B2

(12) United States Patent
Ishimoto et al.

(10) Patent No.: US 7,256,538 B2
(45) Date of Patent: Aug. 14, 2007

(54) AC-DRIVEN GAS DISCHARGE DISPLAY DEVICE HAVING PLURAL THIN DISCHARGE TUBES, PLURAL PAIRS OF DISPLAY ELECTRODES TRANSVERSE TO THE THIN DISPLAY TUBES AND PLURAL SIGNAL ELECTRODES TRANSVERSE TO THE DISPLAY ELECTRODES WITH LIGHT-BLOCKING, ELECTRICALLY CONDUCTIVE FILMS BETWEEN RESPECTIVE PAIRS OF DISPLAY ELECTRODES

(75) Inventors: Manabu Ishimoto, Kawasaki (JP); Hitoshi Hirakawa, Kawasaki (JP); Kenji Awamoto, Kawasaki (JP); Akira Tokai, Kawasaki (JP); Koji Shinohe, Kawasaki (JP)

(73) Assignee: Shinoda Plasma Corporation, Akashi-shi (JP)

( * ) Notice: Subject to any disclaimer, the term of this patent is extended or adjusted under 35 U.S.C. 154(b) by 0 days.

(21) Appl. No.: 11/205,036

(22) Filed: Aug. 17, 2005

(65) Prior Publication Data

US 2006/0220575 A1 Oct. 5, 2006

(30) Foreign Application Priority Data

Mar. 30, 2005 (JP) ..... 2005-096665

(51) Int. Cl.
*H01J 1/62* (2006.01)

(52) U.S. Cl. ..... 313/492; 313/493; 313/505; 313/509

(58) Field of Classification Search ..... 313/942, 313/493, 505, 509, 580, 584, 590, 596, 613, 313/623, 634, 238, 240, 242
See application file for complete search history.

(56) References Cited

U.S. PATENT DOCUMENTS

| | | | | |
|---|---|---|---|---|
| 7,025,649 | B2 * | 4/2006 | Shinoda et al. | 445/24 |
| 7,088,043 | B2 * | 8/2006 | Min et al. | 313/586 |
| 2004/0152389 | A1 * | 8/2004 | Tokai et al. | 445/24 |

FOREIGN PATENT DOCUMENTS

JP 2003-338245 11/2003

* cited by examiner

*Primary Examiner*—Tuyet Thi Vo
(74) *Attorney, Agent, or Firm*—Staas & Halsey LLP

(57) ABSTRACT

In an AC-driven gas discharge display device and especially a plasma tube array type, a return path is provided for alternate discharge current flowing between X and Y driver circuits. The AC-driven gas discharge display device comprises a front-side, transparent substrate and a rear-side substrate sandwiching therebetween a plurality of thin discharge tubes arranged side by side; a plurality of pairs of display electrodes on an inner surface of the front-side substrate; and a plurality of address electrodes, in a direction transverse to the plurality of display electrodes, the rear-side substrate on an inner surface. Striped light-blocking, electrically conductive films are disposed on an outer surface of the front-side substrate at locations between respective ones of the pairs of display electrodes and coupled at their opposite ends to respective points of a common reference potential in the X- and Y-electrode driver circuits, respectively, to provide a return path for alternate discharge current.

6 Claims, 5 Drawing Sheets

AC-DRIVEN GAS DISCHARGE DISPLAY DEVICE HAVING PLURAL THIN DISCHARGE TUBES, PLURAL PAIRS OF DISPLAY ELECTRODES TRANSVERSE TO THE THIN DISPLAY TUBES AND PLURAL SIGNAL ELECTRODES TRANSVERSE TO THE DISPLAY ELECTRODES WITH LIGHT-BLOCKING, ELECTRICALLY CONDUCTIVE FILMS BETWEEN RESPECTIVE PAIRS OF DISPLAY ELECTRODES

FIELD OF THE INVENTION

The present invention generally relates to improvement of an AC gas discharge display device, and, more particularly, to a new structure effectively adaptable for a plasma tube array type AC gas discharge display device, including a number of thin discharge tubes arranged in parallel, to thereby reduce undesirable electromagnetic radiations.

BACKGROUND OF THE INVENTION

A plasma display panel (PDP) is well-known as an AC-driven gas discharge display device, which includes a discharge gas sealed between a pair of glass substrates, and uses a pulsating discharge between dielectric-layer coated electrodes to excite three-primary color phosphors, to thereby provide full-color display. With this panel structure, however, the size of a display screen is restricted by the size of the glass substrates used.

A plasma tube array type AC gas discharge display device has been proposed, which includes an array of a required number of thin discharge tubes having a diameter of 1 mm or less. The screen can have a size determined freely by adjusting the number of the thin discharge tubes used, and, in addition, can have flexibility as a Venetian blind. Accordingly, the display device of this type is expected to be useable to realize what is called a wall display.

An example of prior AC gas discharge display devices of such plasma tube array type is described in JP 2003-338245 A. This gas discharge display device includes a large number of thin discharge tubes arranged side by side and sandwiched between a pair of electrode supporting substrates. The electrode supporting substrate on a display screen side is provided with multifunctional filter means, which improve definition of the display tube.

THE SUMMARY OF THE INVENTION

In accordance with an aspect of the present invention, an AC-driven gas discharge display device comprises a front-side, transparent substrate and a rear-side substrate sandwiching a plurality of thin discharge tubes arranged side by side. The front-side substrate has, on an inner surface thereof, a plurality of pairs of display electrode extending in a direction transverse to the thin display tubes. The rear-side substrate has, on an inner surface thereof, a plurality of signal electrodes extending along the length of the thin discharge tubes in a direction transverse to the plurality of display electrodes. In the AC-driven gas discharge display device, light-blocking, electrically conductive films are formed on an outer surface of the front-side substrate at locations corresponding to locations between respective ones of the pairs of display electrode.

In accordance with another aspect of the present invention, corresponding ones of the display electrodes forming the plurality of pairs of display electrode are led out to one edge of the front-side substrate and connected to one driver circuit, with the other display electrodes led out to the other edge of the front-side substrate and connected to the other driver circuit, and that points of reference potential in the one and the other driver circuits are connected together via the light-blocking, electrically conductive films, whereby the light-blocking, electrically conductive films provide a return path for current flowing between the pairing display electrodes.

DESCRIPTION OF THE PREFERRED EMBODIMENT

Figure 1:
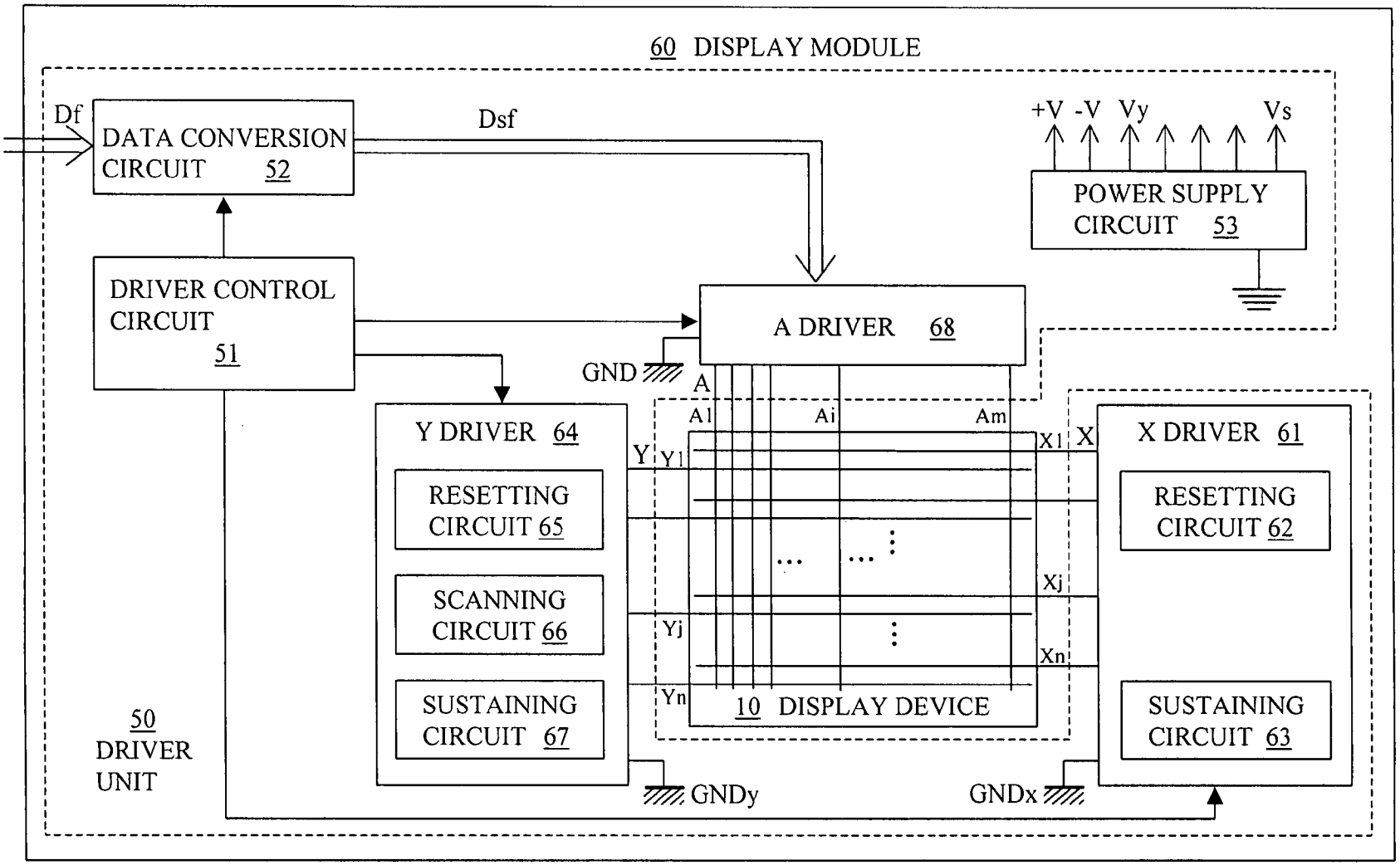
FIG. 1 shows an arrangement of a display module in accordance with an embodiment of the invention.

A conventional PDP includes a display module, which includes a metal chassis serving also as a heat sink or radiation arrangement, disposed in an intimate contact with a rear surface of a rear-side one of a pair of glass substrates forming an envelop defining a gas discharge space, and a driver circuitry board disposed on the chassis. The driver circuitry includes an X driver circuit for a group of display electrodes X's arranged on an inner surface of a front one of the glass substrates, a Y driver circuit for a group of scan/display electrodes Y's arranged thereon, and an address driver circuit for address electrodes arranged on an inner surface of the rear-side substrate. Points of ground potential or reference potential of the respective driver circuits are, as a matter of course, interconnected through the common metal chassis, and, therefore, the metal chassis provides a return path for an alternating discharge current flowing through pairs of display electrodes X's and Y's.

On the other hand, in view of securing the flexibility of the display screen of the above-described plasma tube array type gas discharge display device, it is difficult to provide the device with a metal chassis, like the one used in an ordinary PDP, on the rear surface of the device. Therefore, the X driver circuit at the lead-out end of one of the groups of display electrodes, i.e. the group of display electrodes X's, and the Y driver circuit at the lead-out end of the other group of scan/display electrode's Y's are separately disposed. Accordingly, it is necessary to provide, between the ground potential points of the two driver circuits, a separate connecting path, which functions as a return path for alternating discharge current flowing between the X and Y electrodes in pairs.

An object of the present invention is to provide an efficient and useful connecting arrangement, which can provide a return path for alternating discharge current, between points of reference potentials of the respective driver circuits for pairs of display electrodes of an AC gas discharge display device.

Another object of the invention is to provide a plasma tube array type AC gas discharge display device with improved contrast and reduced undesired electromagnetic radiations in a simple arrangement.

Since a front-side display electrode supporting substrate, which supports pairs of display electrodes of a gas discharge display device of a plasma tube array type with thin discharge tubes arranged side by side, does not need to serve as part of a container for a discharge gas as in an common PDP, the display electrode supporting substrate can be formed of a thin sheet of about 0.1 mm in thickness. Briefly speaking, according to the invention, based on this recognition, striped light-blocking or light-shielding films (black stripes), which are usually formed between adjacent ones of display lines on the same surface as the pairs of display electrodes to avoid parallactic problems caused by the distance between front and rear surfaces of the electrode supporting substrate, are formed in the form of light-blocking, electrically conductive films on the outer surface opposite to the surface on which the display electrode pairs are formed. The light-blocking, electrically conductive films are utilized as the return paths for the discharge current flowing between display electrode pairs.

According to the invention, light-blocking, electrically conductive, striped films, which are formed on an outer surface of a front-side electrode supporting substrate of an AC gas discharge display device in such a positional relation as to be adjacent to respective ones of display electrode pairs, function as return paths for alternating discharge current flowing between the pair-forming display electrodes, through which current flows in the opposite direction to the currents flowing through the display electrodes. This results in reduction of undesired electromagnetic radiations. Furthermore, because the striped light-blocking, electrically conductive films are disposed on a surface different from a surface on which the pairs of display electrodes are formed, and function as what is called black stripes between display lines defined by the respective pairs of display electrodes, the display contrast may be improved with an inexpensive arrangement.

The invention will be described with reference to the accompanying drawings. Throughout the drawings, similar symbols and numerals indicate similar items and functions.

FIG. 1 shows an arrangement of a display module 60 employing an exemplary AC gas discharge display device, in accordance with an embodiment of the invention. The display module 60 includes a gas discharge display device of a plasma tube array type 10, including the number, m, of vertically extending thin discharge tubes horizontally arranged side by side, which are sandwiched between a rear-side electrode supporting substrate having thereon m address electrodes A1 through Am extending along the length direction of the respective thin discharge tubes, and a front-side electrode supporting substrate having thereon the number, n, of display electrode pairs X1 through Xn and Y1 through Yn extending transverse to the thin discharge tubes, to thereby form a matrix or array of m×n discharge cells. There is provided a drive unit 50 for selectively causing discharge cells in the matrix array of the gas discharge display device 10 to emit light so that a desired picture can be displayed. The module as a whole can be used as a television receiver and a monitor of a computer system, for example.

For simplification of illustration, the plasma tube array type gas discharge display device 10 is schematically shown, in FIG. 1, only in terms of its electrode arrangement, and a detailed arrangement of its entirety will be described later together with the features of the invention.

The driver unit 50 includes a driver control circuit 51, a data conversion circuit 52, a power supply circuit 53, an X electrode driver circuit or X driver circuit 61, a Y electrode driver circuit or Y driver circuit 64, and an addressing electrode driver circuit or A driver circuit 68. The X driver circuit 61, the Y driver circuit 64, and the A driver circuit 68 are coupled to a common reference potential or ground potential GDN. The driver unit 50 is implemented in the form of an integrated circuit, which may possibly contain an ROM. A field of data Df representative of the magnitudes of light emission for the three primary colors of R, G and B is provided together with various synchronization signals to the driver unit 50 from an external device, such as a TV tuner or a computer. The field data Df is temporarily stored in a field memory of the data conversion circuit 52. The data conversion circuit 52 converts the field data Df into subfields of data Dsf for displaying in gradation, and provides the subfield data Dsf to the A driver circuit 68. The subfield data Dsf is a set of display data associating one bit with each cell, and the value for each bit represents whether or not each cell should emit light during the corresponding one subfield SF.

The X driver circuit 61 includes a resetting circuit 62 for applying a voltage for initialization to the display electrodes X's to initialize the wall voltages in a plurality of cells forming the display screen, and a sustaining circuit 63 for applying sustain pulses to the display electrodes X's to cause the cells to produce discharge for displaying. The Y driver circuit 64 includes a resetting circuit 65 for applying a voltage for initialization to the display electrodes Y's, a scanning circuit 66 for applying scan pulses sequentially to the display electrodes Y's for addressing, and a sustaining circuit 67 for applying sustain pulses to the display electrodes Y's to cause the cells to produce discharge for displaying. The A driver circuit 68 applies address pulses to the address electrodes A's designated in the subfield data Dsf in accordance with the displaying data.

Figure 2:
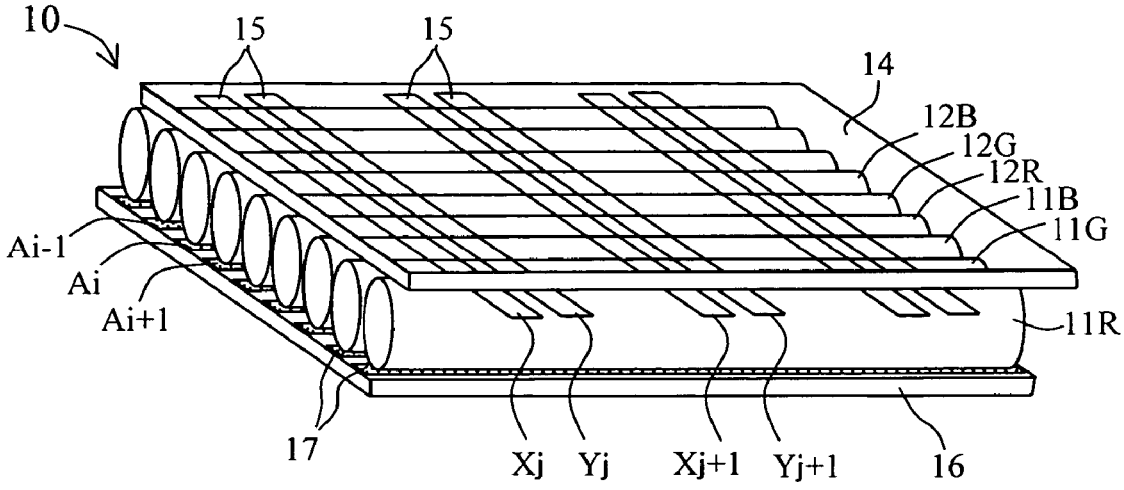
FIG. 2 shows a schematic structure of a plasma tube array type gas discharge display device.

FIG. 2 shows an exemplary discharge cell structure of the plasma tube array type gas discharge display device 10. The display device 10 includes a desired number of circular or elliptical thin discharge tubes 11 arranged in parallel. The tubes 11 each have an outer diameter of about 1 mm or so and a wall thickness of several tens of microns or about 80 microns, and are sandwiched, from above and below, between thin electrode supporting substrates 14 and 16 formed of plastic or glass. The thin discharge tubes 11 each have one of R, G and B emitting phosphors therein, and are filled with a discharging gas mixture, and their opposite ends are closed. A repetition of sets of color-light emitting thin discharge tubes 11R, 11G and 11B arranged in this order is arranged.

On an inner surface of the front-side electrode supporting substrate 14 formed of transparent plastic or glass, the display electrodes X's and Y's forming display electrode pairs 15 are arranged so as to define rows (display lines) of discharge cells arranged in the matrix of n rows and m columns. On the upper or inner surface of the rear-side electrode supporting substrate 16, the address electrodes A's are arranged so as to extend along respective ones of the thin discharge tubes and form a set of address electrode 17 equal in number to the thin discharge tubes. In the figure, the subscript j to the display electrodes X and Y indicates the position of an arbitrary row and the subscript i to the address electrode A indicates the position of an arbitrary column. Although not shown in detail, the display electrodes X and Y of each pair include transparent, electrically conductive film portions forming a surface discharge slit between mutually adjacent facing portions thereof, and metallic film bus electrode portions disposed on the opposite edges thereof. Alternatively, transparent display electrode pair portions may be formed on outer surfaces of individual thin discharge tubes, while the front-side electrode supporting substrate is provided only with metallic bus electrodes connecting the display electrode pairs in the respective rows. In this way, discharge cells, which are display units, are defined at locations in the thin discharge tubes corresponding to the intersections of the respective display electrode pairs 15 and the address electrodes A, with three, R, G and B, color-emitting discharge cells arranged side by side, forming one pixel.

Figure 3:
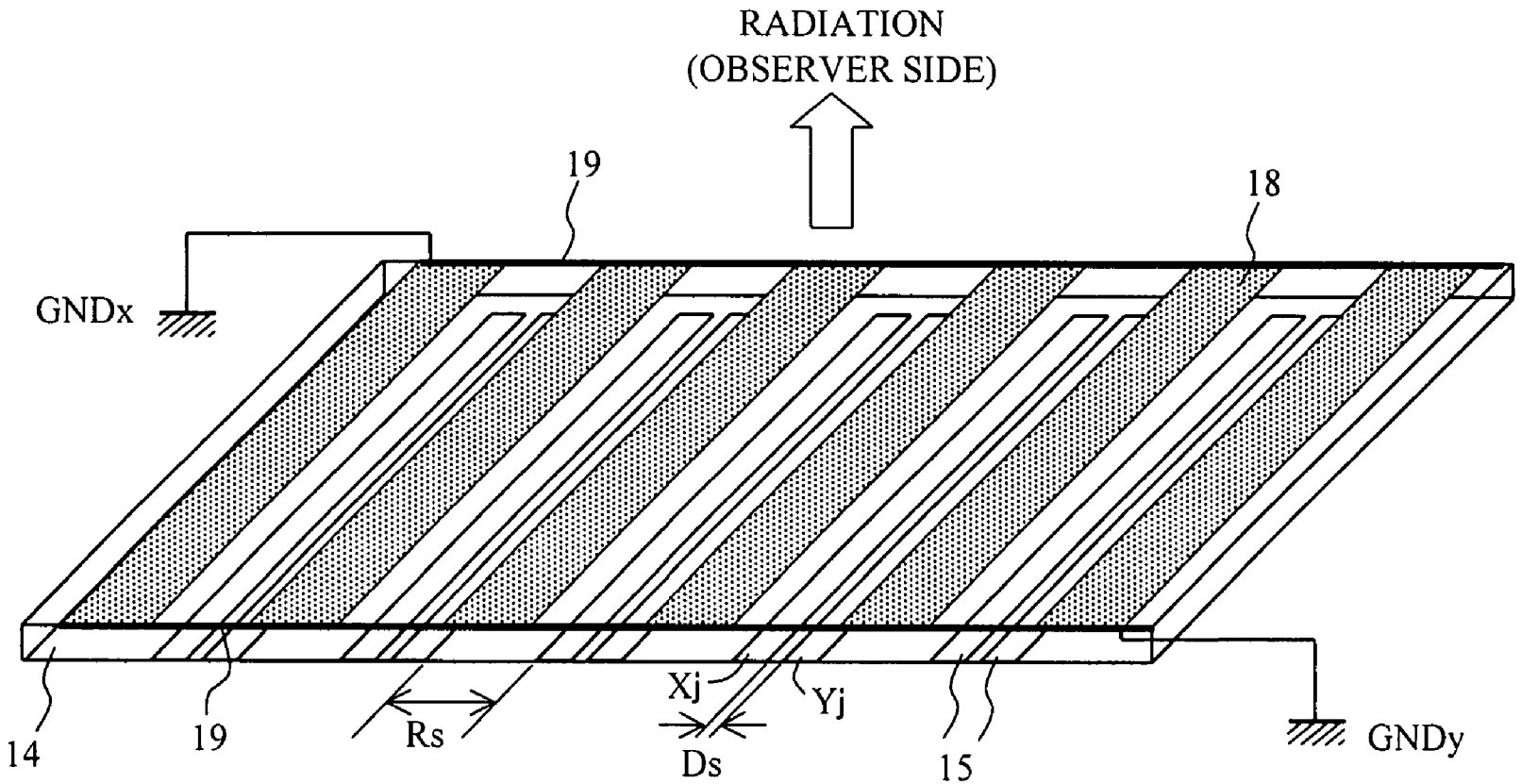
FIG. 3 is a perspective view of a schematic structure of a front-side electrode supporting substrate in accordance with the embodiment of the invention.

FIG. 3 is a perspective view of a schematic structure of a front-side electrode supporting substrate 14 in accordance with the embodiment of the invention. As schematically shown in FIG. 3, according to the invention, striped films 18 of light-blocking, electrically conductive material are formed on an outer surface of the front-side electrode supporting substrate 14 at locations corresponding to regions between display lines. Specifically, in FIG. 3, pairs of transparent display electrodes X's and Y's 15 with such a discharge slit Ds disposed therebetween as to cause a discharge in respective thin discharge tubes 11 are formed, on the inner surface of the sheet-like substrate 14 having a thickness of about 0.1 mm formed of a resin, e.g. PET, or glass, for n display lines, with inner-pixel gaps Rs disposed between the adjacent pairs of display electrode 15. The width of the inner-pixel gap Rs is such defined as not to cause a discharge between the adjacent display electrode pairs. On each of the inner-pixel gap sides of each display electrode pair, disposed is a metallic bus electrode (not shown) as in a common PDP arrangement. Black or dark, light-blocking, electrically conductive films 18, according to a feature of the invention, are formed to form a stripe on the outer surface of the substrate 14 at locations corresponding to the inner-pixel gaps Rs between the display electrode pairs. The light-blocking, electrically conductive films 18 functioning as a black stripe have their opposite ends connected to common conductors 19 and led to terminals connected to points of reference potential GNDx and GNDy. The plural light-blocking, electrically conductive films 18 and the common conductors 19 are formed of light-blocking, electrically conductive films containing a black or dark conductive material, e.g. blackened chrome and carbon. Alternatively, the films 18 and conductors 19 may be formed of silver paste with black pigment added thereto.

A pattern of the light-blocking, electrically conductive films 18 is formed by first applying a sensitized black, electrically conductive paste of the above-mentioned material over the outer surface of the substrate and, then, shaping the applied paste into a stripe pattern by photolithography, or may be formed by printing light-blocking striped films with a black, electrically conductive ink. Alternatively, a metal film, which is black or can be made black afterwards, may be first formed over the entire surface by vapor deposition and, then, patterned into striped, light-blocking, electrically conductive films by photolithography. The thus formed light-blocking, electrically conductive films each may have a width entirely covering the portion corresponding to the corresponding inner-pixel gap Rs, or may be stripes each formed at the center of the respective one of the inner-pixel gaps with spacings left between the opposing edges of the inner-pixel gap. In any cases, the light-blocking, electrically conductive films 18 are formed on a surface different from the surface on which the pairs of display electrodes X's and Y's are formed, and, therefore, they can be formed at low costs because there is no need to take physical positioning and chemical reaction between materials into account when they are formed.

Now, one example of methods for driving AC gas discharge display device of this type is described. For displaying a moving picture in a conventional television system, thirty frames per second must be displayed. In displaying on the AC gas discharge display device of the type, for reproducing colors by the binary control of light emission, one field F is typically divided into or replaced with a set of q subfields SF's. Often, the number of times of discharging for display for each subfield SF is set by weighting these subfields SF's with respective weighting factors of $2^0$, $2^1$, $2^2$, . . . , $2^{q-1}$ in this order. N ($=1+2^1+2^2+ \ldots +2^{q-1}$) steps of brightness can be provided for each color of R, G and B in one field by associating light emission or non-emission with each of the subfields in combination. In accordance with such a field structure, a field period Tf, which represents a cycle of transferring field data, is divided into q subfield periods Tsf's, and the subfield periods Tsf's are associated with respective subfields SF's of data. Furthermore, a subfield period Tsf is divided into a reset period TR for initialization, an address period TA for addressing, and a display or sustain period TS for emitting light. Typically, the lengths of the reset period TR and the address period TA are constant independently of the weighting factors for the brightness, while the number of pulses in the display period becomes larger as the weighting factor becomes larger, and the length of the sustain period TS becomes longer as the weighting factor becomes larger. In this case, the length of the subfield period Tsf becomes longer, as the weighting factor of the corresponding subfield SF becomes larger.

Figure 4:
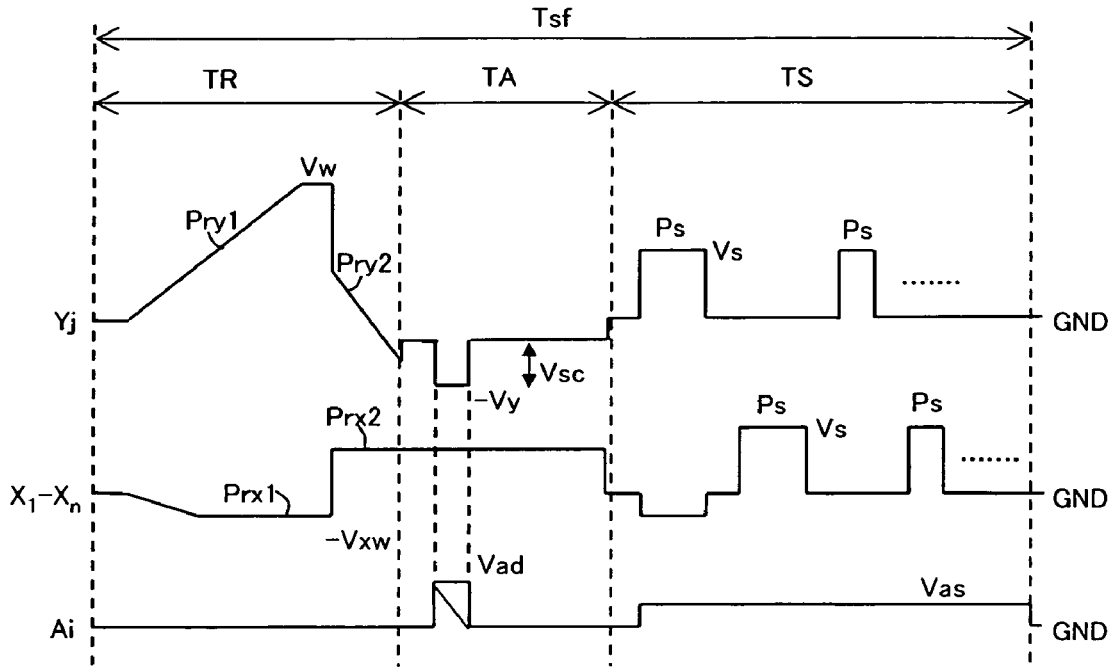
FIG. 4 shows a schematic driving sequence of output driving voltage waveforms of the X driver circuit, the Y driver circuit and the A driver circuit.

FIG. 4 shows a schematic driving sequence of output driving voltage waveforms of the X driver circuit 61, the Y driver circuit 64 and the A driver circuit 68, in accordance with the embodiment of the invention. The waveform shown is an example, and the amplitudes, polarities and timings of the waveforms may be varied differently.

The q subfields SF's have the same order of a reset period TR, an address period TA and a sustain period TS in the driving sequence, and this sequence is repeated for each subfield SF. During a reset period TR of each subfield SF, a negative polarity pulse Prx1 and a positive polarity pulse Prx2 are applied in this order to all of the display electrodes X's, and a positive polarity pulse Pry1 and a negative polarity pulse Pry2 are applied in this order to all of the display electrodes Y's. The pulses Prx1, Pry1 and Pry2 have ramping waveforms having the amplitudes which gradually increase at the rates of variation that produce micro-discharge. The first pulses Prx1 and Pry1 are applied to produce, in all of the cells, appropriate wall voltages having the same polarity, regardless of whether the cells have been illuminated or unilluminated during the previous subfield. Subsequently, the second pulses Prx2 and Pry2 are applied to the discharge cells on which an appropriate amount of wall charge is present, which adjusts the wall charge to decrease to a level (blanking state) at which sustain pulses cannot cause re-discharging. The driving voltage applied to the cell is a combined voltage which represents difference between the amplitudes of the pulses applied to the respective display electrodes X and Y.

During the address period TA, wall charges required for sustaining illumination are formed only on the cells to be illuminated. While all of the display electrodes X's and of the display electrodes Y's are biased at the respective predetermined potentials, a negative scan pulse voltage −Vy is applied to a row of a display electrode Y corresponding to a selected row for each row selection interval (a scanning interval for one row of the cells). Simultaneously with this row selection, an address pulse voltage Va is applied only to address electrodes A's which correspond to the selected cells to produce address discharges. Thus, the potentials of the address electrodes A1 to Am are binary-controlled in accordance with the subfield data Dsf for m columns in the selected row j. This causes address discharges to occur in the thin discharge tubes of the selected cells between the display electrode Y's and the address electrode A's, and the display data written by the address discharges is stored in the form of wall charges on the cell inner walls of the thin discharge tubes. A sustain pulse applied subsequently causes surface discharges between the display electrodes X's and Y's.

During the sustain period TS, a first sustain pulse Ps is applied so that a polarity of the first sustain pulse Ps (i.e., the positive polarity in the illustrated example) is added to the wall charge produced by the previous address discharge to cause a sustain discharge. Then, the sustain pulse Ps is applied alternately to the display electrodes X's and the display electrodes Y's. The amplitude of the sustain pulse Ps corresponds to the sustaining voltage Vs. The application of the sustain pulse Ps produces surface discharge in the discharge cells which have a predetermined amount of residual wall charge. The number of applied sustain pulses Ps's corresponds to the weighting factor of the subfield SFas described above.

Figure 5:
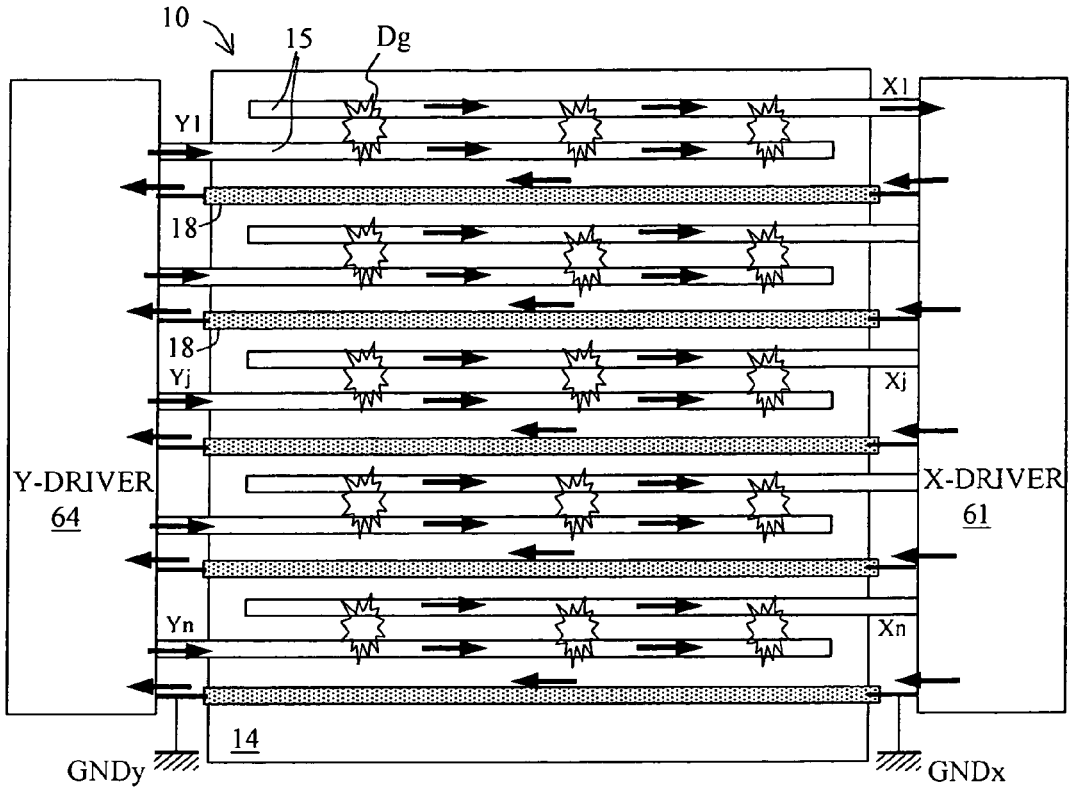
FIG. 5 is a schematic front view of the front-side electrode supporting substrate according to the invention, which is useful for explaining the flow of discharge current.

FIG. 5 is a schematic front view of the AC gas discharge display device according to the invention, which is useful for explaining the flow of discharge current, in which arrows indicate the direction of flow of the discharge current. As is understood from FIG. 5, according to the present invention, the point of reference potential GNDy of the Y driver circuit 64 and the point of reference potential GNDx of the X driver circuit 61 of the display module 60 shown in FIG. 1 are interconnected by means of the light-blocking, electrically conductive films 18.

FIG. 5 illustrates the state in which a positive-polarity sustain voltage is applied by the Y driver circuit 64 to a Y electrode Yj. The discharge current is supplied from the Y driver circuit 64 to the Y electrode, flowing through a discharge cell indicated with a discharge symbol Dg and a pairing X electrode Xj to the X driver circuit 61. The discharge current flows further from the point of reference potential GNDx of the X driver circuit 61 through the light-blocking, electrically conductive films 18 back to the point of reference potential GNDy of the Y driver circuit 64. On the other hand, when a positive-polarity sustain voltage is applied from the X driver circuit 64 to the X electrodes, discharge current will flow in the direction opposite to the direction indicated by the arrows shown. Since the spacing between the black or dark, light-blocking, electrically conductive films 18 and the display electrode pairs 41 is small, the current flowing through the display electrode pairs 41 and the current flowing in opposite directions through the light-blocking, electrically conductive films 18 counteract each other to thereby suppress generation of harmful, undesired electromagnetic radiations. Furthermore, since the light-blocking, electrically conductive films 18 are disposed on the outer surface of the substrate 14 with the same pitch as the display lines and are coupled together to the points of reference potential, GNDx and GNDy, the films 18 themselves exhibit effect as an electromagnetic wave shield. This may make it possible, in some cases, to eliminate use of an electromagnetic shield film which has been discretely disposed as part of a function filter on the front side of conventional devices.

Figure 6:
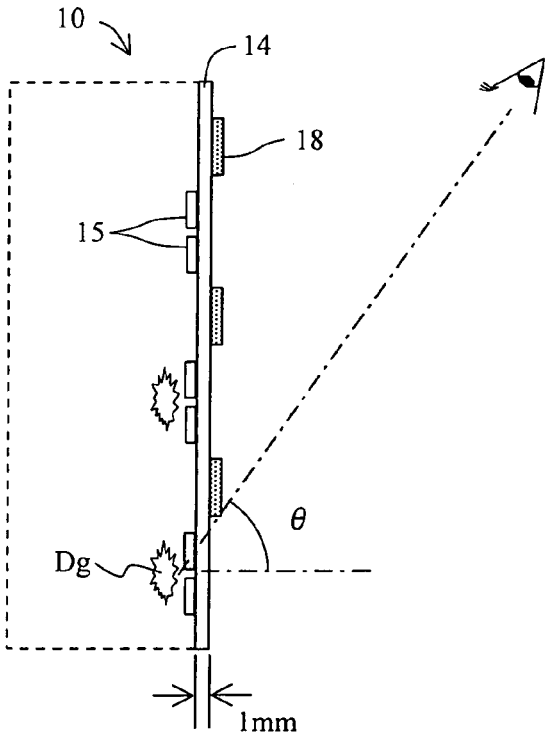
FIG. 6 is a schematic cross-sectional side view of the front-side electrode supporting substrate of the AC gas discharge display device in accordance with the invention, which is useful for explaining optical characteristics of the substrate.

FIG. 6 is a schematic cross-sectional side view of the front-side electrode supporting substrate 14 of the AC gas discharge display device 10 in accordance with the invention, which is useful for explaining optical characteristics of the substrate 14. According to the invention, which has been made chiefly for application to an AC gas discharge display device of plasma tube array type, since the front-side electrode supporting substrate 14 is a resin or glass sheet having a thickness of about 1 mm, which is smaller than those used in conventional PDPs, the light-blocking, electrically conductive films 18 disposed on the outer surface of the substrate 14 narrow only little the viewing angle θ relative to the cell discharge Dg within the discharge tubes, which are in contact with the inner surface of the substrate 14. In addition, since the flexibility of the patterning and processing of the light-blocking, electrically conductive films 18 is high, the films 18 can be made to exhibit display quality improving function as a black stripe can essentially do, while giving least influence to the viewing angle.

According to the embodiment of the invention, the striped, light-blocking, electrically conductive films 18 are formed on the outer surface of the front-side glass substrate 14, whereby a gas discharge display device having an improved contrast with a simple arrangement can be provided at low costs. Furthermore, the striped, light-blocking, electrically conductive films 18 connected to the points of reference potentials in the X and Y driver circuits can suppress generation of undesired electromagnetic radiations.

The above-described embodiment of the plasma tube array type AC gas discharge display device is only a typical example, and its modifications and variations are apparent to those skilled in the art. It should be noted that those skilled in the art can make various modifications to the above-described embodiment without departing from the principle of the invention and the accompanying claims. The invention can be embodied not only in PDPs in general, but also in inorganic or organic ELs, and electronic paper on which characters and the like are displayed by charges stored thereon through an application of a voltage thereto.

What is claimed is:

1. An AC-driven gas discharge display device, comprising:

a front-side, transparent substrate and a rear-side substrate sandwiching therebetween a plurality of thin discharge tubes arranged side by side, said front-side substrate having, on an inner surface thereof, a plurality of pairs of display electrodes extending in a direction transverse to said thin discharge tubes, said rear-side substrate having, on an inner surface thereof, a plurality of signal electrodes extending along a length of said thin discharge tubes in a direction transverse to said plurality of display electrodes; and light-blocking, electrically conductive films on an outer surface of said front-side substrate at locations between respective ones of said pairs of display electrodes, said light-blocking, electrically conductive films being formed of black, electrically conductive material as stripes disposed between respective, adjacent ones of the pairs of display electrodes with respective, opposite ends thereof connected together.

2. An AC-driven gas discharge display device according to claim 1, further comprising:

corresponding ones of the display electrodes, forming said plurality of pairs of display electrodes, being led out to one edge of said front-side substrate and connected to one driver circuit and the other display electrodes being led out to the other edge of said front-side substrate and connected to the other driver circuit; and points of reference potential in said one and the other driver circuits being connected together via said light-blocking, electrically conductive films.

3. An AC-driven gas discharge display device according to claim 1, further comprising:

corresponding ones of the display electrodes, forming said plurality of pairs of display electrodes, being led out to one edge of said front-side substrate and connected to one driver circuit, the other display electrodes being led out to the other edge of said front-side substrate and connected to the other driver circuit; and points of reference potential in said one and the other driver circuits being connected together via said light-blocking, electrically conductive films.

4. An AC-driven gas discharge display device according to claim 2, further comprising:

said points of reference potential being points of ground potential; and said light-blocking, electrically conductive films providing a return path for current flowing between the pairs of display electrodes.

5. An AC-driven gas discharge display device according to claim 3, further comprising:

said points of reference potential being points of ground potential; and said light-blocking, electrically conductive films providing a return path for current flowing between the pairs of display electrodes.

6. An AC-driven gas discharge display device, comprising:

a transparent front-side electrode supporting substrate having, on an inner surface thereof, a plurality of pairs of display electrodes substantially in parallel with each other and defining rows of a display screen; and electrically conductive, light-blocking films on an outer surface of said front-side electrodes at locations between adjacent ones of said pairs of respective display electrodes, said electrically conductive, light-blocking films being formed of black, electrically conductive material as stripes disposed between respective, adjacent ones of the pairs of display electrodes, with respective, opposite ends thereof connected together.

* * * * *

UNITED STATES PATENT AND TRADEMARK OFFICE

CERTIFICATE OF CORRECTION

PATENT NO. : 7,256,538 B2
APPLICATION NO. : 11/205036
DATED : August 14, 2007
INVENTOR(S) : Manabu Ishimoto et al.

It is certified that error appears in the above-identified patent and that said Letters Patent is hereby corrected as shown below:

Title Page, Item (54) Title: Change "AC-DRIVEN GAS DISCHARGE DISPLAY DEVICE HAVING PLURAL THIN DISCHARGE TUBES, PLURAL PAIRS OF DISPLAY ELECTRODES TRANSVERSE TO THE THIN DISPLAY TUBES AND PLURAL SIGNAL ELECTRODES TRANSVERSE TO THE DISPLAY ELECTRODES WITH LIGHT-BLOCKING, ELECTRICALLY CONDUCTIVE FILMS BETWEEN RESPECTIVE PAIRS OF DISPLAY ELECTRODES" to --A GAS DISCHARGE DISPLAY DEVICE HAVING DISCHARGE TUBES, DISPLAY ELECTRODES WITH LIGHT-BLOCKING NON-CONDUCTIVE FILMS THEREBETWEEN, TRANSVERSE TO THE DISCHARGE TUBES, AND SIGNAL ELECTRODES TRAVERSE TO THE DISPLAY ELECTRODES--.

Column 1 (Title), Line 1-11, change "AC-DRIVEN GAS DISCHARGE DISPLAY DEVICE HAVING PLURAL THIN DISCHARGE TUBES, PLURAL PAIRS OF DISPLAY ELECTRODES TRANSVERSE TO THE THIN DISPLAY TUBES AND PLURAL SIGNAL ELECTRODES TRANSVERSE TO THE DISPLAY ELECTRODES WITH LIGHT-BLOCKING, ELECTRICALLY CONDUCTIVE FILMS BETWEEN RESPECTIVE PAIRS OF DISPLAY ELECTRODES" to --A GAS DISCHARGE DISPLAY DEVICE HAVING DISCHARGE TUBES, DISPLAY ELECTRODES WITH LIGHT-BLOCKING NON-CONDUCTIVE FILMS THEREBETWEEN, TRANSVERSE TO THE DISCHARGE TUBES, AND SIGNAL ELECTRODES TRAVERSE TO THE DISPLAY ELECTRODES--.

Signed and Sealed this

Fourth Day of December, 2007

JON W. DUDAS
*Director of the United States Patent and Trademark Office*